US011802428B2

(12) United States Patent
Romero

(10) Patent No.: US 11,802,428 B2
(45) Date of Patent: Oct. 31, 2023

(54) FLUSH BOLT ASSEMBLY WITH BOLT-CONTAINED SPRING

(71) Applicant: Overhead Door Corporation, Lewisville, TX (US)

(72) Inventor: Federico Romero, Corpus Christi, TX (US)

(73) Assignee: Overhead Door Corporation, Lewisville, TX (US)

( * ) Notice: Subject to any disclaimer, the term of this patent is extended or adjusted under 35 U.S.C. 154(b) by 913 days.

(21) Appl. No.: 16/212,426

(22) Filed: Dec. 6, 2018

(65) Prior Publication Data

US 2020/0181958 A1 Jun. 11, 2020

(51) Int. Cl.

| | |
|---|---|
| ***E05C 7/06*** | (2006.01) |
| ***E05C 1/08*** | (2006.01) |
| ***E05C 7/04*** | (2006.01) |

(52) U.S. Cl.

CPC ..... *E05C 1/085* (2013.01); *E05C 7/045* (2013.01)

(58) Field of Classification Search

CPC . E05C 7/045; E05C 1/085; E05C 7/06; E05C 1/00; E05C 1/004; E05C 1/006; E05C 1/08; E05C 1/10; Y10T 292/096; Y10T 292/0997; Y10T 292/1022; Y10T 292/1023; Y10T 292/1024; Y10T 292/1028; Y10S 292/15; Y10S 292/30; Y10S 292/46

See application file for complete search history.

(56) References Cited

U.S. PATENT DOCUMENTS

| | | | | | |
|---|---|---|---|---|---|
| 194,825 | A * | 9/1877 | Judd | E05B 65/0864 | 16/DIG. 30 |
| 262,978 | A * | 8/1882 | Osborn | E05B 37/20 | 292/180 |
| 475,368 | A * | 5/1892 | Welch | E05C 7/06 | 292/179 |
| 717,222 | A * | 12/1902 | Lathrop | E05C 1/04 | |
| 858,905 | A * | 7/1907 | Passino | E05B 85/22 | 292/DIG. 19 |
| 927,824 | A * | 7/1909 | Welch | E05C 7/06 | 70/DIG. 65 |

(Continued)

FOREIGN PATENT DOCUMENTS

| | | | | | |
|---|---|---|---|---|---|
| CA | 2894103 | A1 * | 12/2015 | E05B 63/0004 | |
| CN | 202926055 | U * | 5/2013 | E05B 15/0086 | |
| FR | 340815 | A * | 7/1904 | E06C 1/10 | |

OTHER PUBLICATIONS

Assa Abloy, Architectural Door Accessories, Rockwood 2805 Self Latching Top Bolt, Template T-2805, Rockwood, Pennsylvania, Jan. 1, 2017, 1 page.

(Continued)

*Primary Examiner* — Kristina R Fulton
*Assistant Examiner* — Tal Saif
(74) *Attorney, Agent, or Firm* — Haynes and Boone, LLP

(57) ABSTRACT

A flush bolt assembly includes a latch bolt that has a head and a body. The body has an interior cavity that is defined by a plurality of walls. A guide slot is formed in a pair of sidewalls. The assembly also includes a sleeve that defines a through hole that is configured to receive a pin. A biasing member is disposed within the interior cavity, and it is configured to store energy upon being compressed between the sleeve and the latch bolt.

4 Claims, 4 Drawing Sheets

(56) References Cited

U.S. PATENT DOCUMENTS

| | | | | | |
|---|---|---|---|---|---|
| 1,338,713 | A * | 5/1920 | Toney | E05C 7/06 | 292/226 |
| 2,518,207 | A * | 8/1950 | Wagner | E05C 1/10 | 70/451 |
| 3,455,591 | A | 7/1969 | Powers | | |
| 4,005,886 | A | 2/1977 | Lirette | | |
| 4,049,304 | A | 9/1977 | Imhoff | | |
| 4,611,840 | A | 9/1986 | Martin | | |
| 4,643,005 | A * | 2/1987 | Logas | E05C 9/026 | 70/95 |
| 5,042,854 | A * | 8/1991 | Huang | E05C 1/10 | 292/163 |
| 5,746,455 | A * | 5/1998 | Takimoto | E05C 1/04 | 292/145 |
| 9,151,093 | B2 * | 10/2015 | Lin | E05C 7/045 | |
| 9,404,295 | B2 * | 8/2016 | Baczuk | E05C 19/00 | |
| 9,523,221 | B2 * | 12/2016 | Do | E05B 65/0817 | |
| 2006/0208499 | A1 * | 9/2006 | Rusiana | E05B 15/101 | 292/170 |
| 2010/0244465 | A1 * | 9/2010 | de Mola | E05C 1/12 | 292/60 |

OTHER PUBLICATIONS

Assa Abloy, Architectural Door Accessories, Rockwood 2849 Self Latching Flush Bolt with Bottom Fire Bolt for Fire Rated Metal Doors, Rockwood, Pennsylvania, Jan. 2017, 1 page.

* cited by examiner

FLUSH BOLT ASSEMBLY WITH BOLT-CONTAINED SPRING

BACKGROUND

Technical Field

The present invention relates generally to sliding door systems, and more particularly to a flush bolt assembly that includes a spring contained within a latch bolt.

Description of Related Art

Conventional flush bolt mechanisms often include one or more springs that bias a latch bolt or lock bolt to project out of the door where it can be received by a keeper. Typically, the spring is external to the latch bolt (or lock bolt). U.S. Pat. No. 4,005,886 to Lirette entitled, "Flush Bolt Mechanisms," which is incorporated by reference, discloses flush bolt mechanisms with two external springs biasing components of the mechanisms. In a metal door system, the springs may be external to the flush bolt assembly, and therefore may only be protected by the door rail in which the flush bolt mechanism is installed. As such, the spring is exposed to dirt, debris, and damage.

SUMMARY

A flush bolt assembly includes a latch bolt that has a head and a body. The body has an interior cavity that is defined by a plurality of sidewalls. A guide slot is formed in the pair of sidewalls. The assembly also includes a sleeve that defines a through hole that is configured to receive a pin. A biasing member is disposed within the interior cavity, and it is configured to store energy upon being compressed between the sleeve and the latch bolt.

A technical advantage of a flush bolt assembly according to the teachings of the present disclosure includes a latch bolt that contains and protects a spring. This may be a considerable improvement over conventional latch bolt assemblies that include one or more external springs that are exposed to dirt, debris, and damage.

Other technical advantages will be readily apparent to one of ordinary skill in the art from the following figures, descriptions, and claims. Moreover, while specific advantages have been described above, various embodiments may include all, some, or none of the enumerated advantages.

BRIEF DESCRIPTION OF THE DRAWINGS

A more complete understanding of the present invention may be acquired by reference to the following Detailed Description when taken in conjunction with the accompanying Drawings wherein.

DETAILED DESCRIPTION OF THE DRAWINGS

A flush bolt assembly for use with a door system is disclosed. The flush bolt assembly is coupled to a latch assembly. The door may be a sliding or swinging door and may be operated manually or may be driven by a motor to operate automatically. The door may be a wooden door or a metal door. According to one embodiment, the door is a metal door that includes multiple glass panes.

The flush bolt assembly includes a compression spring that is contained within a latch bolt (also referred to as a lock bolt or a flush bolt). More specifically, the latch bolt includes an interior cavity. The spring is received within this interior cavity. The latch bolt also includes a guide slot that guides the linear movement of the latch bolt with respect to a sleeve inserted within the interior cavity of the latch bolt. A tie rod or connecting rod engages the sleeve at one end and an actuation mechanism at an opposite end. The guide sleeve guides a pin that is engaged with the sleeve. The latch bolt is biased in an upward and latched position, but closing the door through a sliding or swinging motion will displace the latch bolt until the latch bolt clears a strike plate and the spring returns the latch bolt to its extended and latched position within a keeper. With the latch bolt received within the keeper, the door is latched in a closed position.

The linear movement of the lock bolt caused by a strike plate portion of the bolt keeper compresses the spring against the sleeve and an interior wall/surface of the latch bolt. The latch bolt moves linearly while the sleeve stays stationary and the spring compresses. Also, when an actuating mechanism is actuated. The full flush bolt assembly including the sleeve, the pin, and the lock bolt are all simultaneously linearly displaced to disengage the latch bolt from the keeper. Disengagement of the latch bolt unlatches the door to allow it to be opened, for example to a breakout position. Depending on the type of door, the door may swing open from a door frame or may slide linearly within the door frame upon disengagement of the latch bolt.

Figure 1:
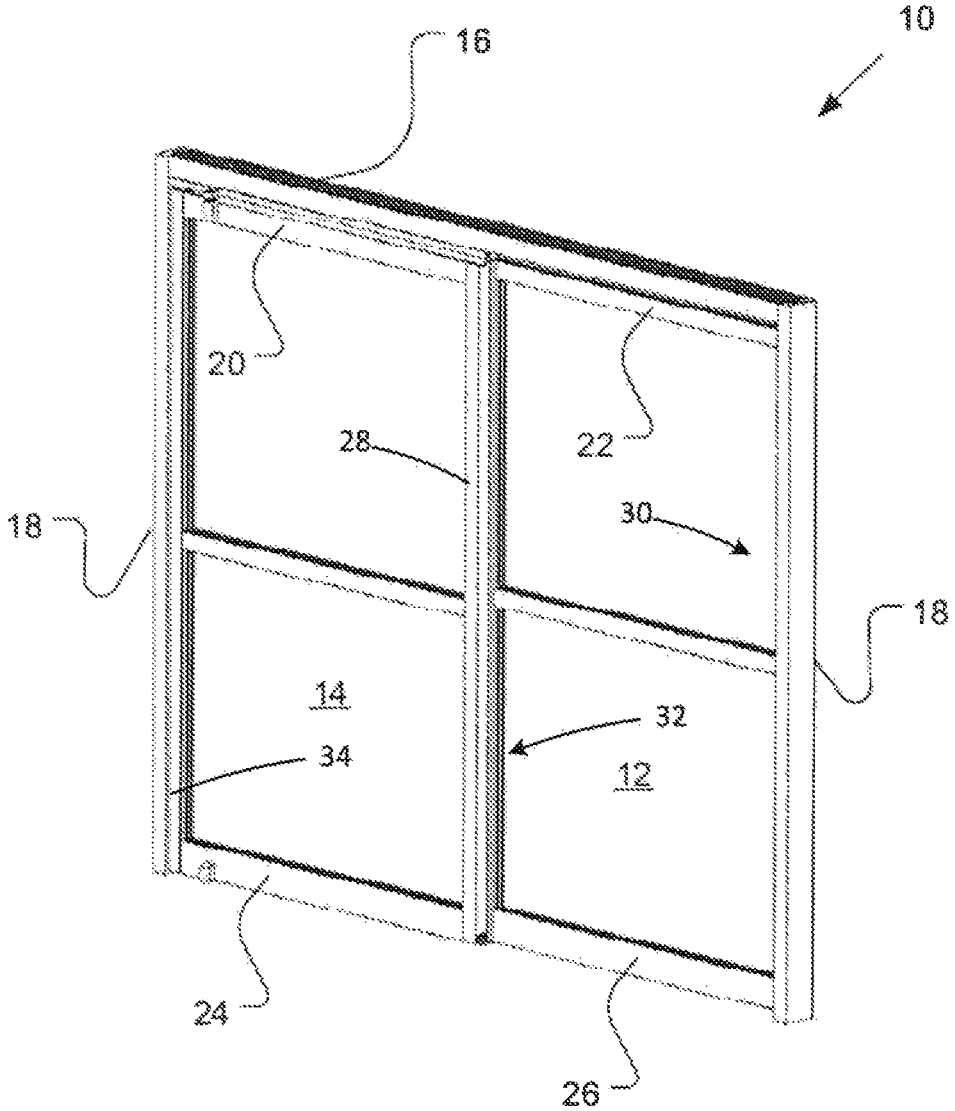
FIG. 1 shows a perspective view of a sliding door system according to the teachings of the present disclosure.

Reference is made to FIG. 1, which shows an isometric view of a sliding door system 10. The door system 10 includes a slide panel 12 and a sidelite 14. The slide panel 12 is known in the art as the "SX," and the sidelite 14 is known as the "SO." The slide panel 12 and the sidelite panel 14 are both supported by a header 16. The header 16 includes the track that guides the linear motion of the slide panel 12 with respect to the sidelite 14. The bottom of the slide panel 12 may also be guided by a track (not shown) that is typically fixed to the floor. Alternatively, the door system 10 may be a trackless sliding door system, which omits the floor track.

Both the slide panel 12 and the sidelite 14 include one or more panes of glass between a top rail 20, 22, a bottom rail 24, 26, a lead rail 28, 30, and a trailing rail 32, 34. The rails may be made of any suitable material, for example aluminum. The door system 10 also includes jambs 18 that are fixed to the structure of the building. The door system 10 shown in FIG. 1 is a single slide-type door system. However, the teachings of the present disclosure are not limited to a single slide door system, but rather may be employed with a biparting door system or a three-panel single slide door system.

Figure 2:
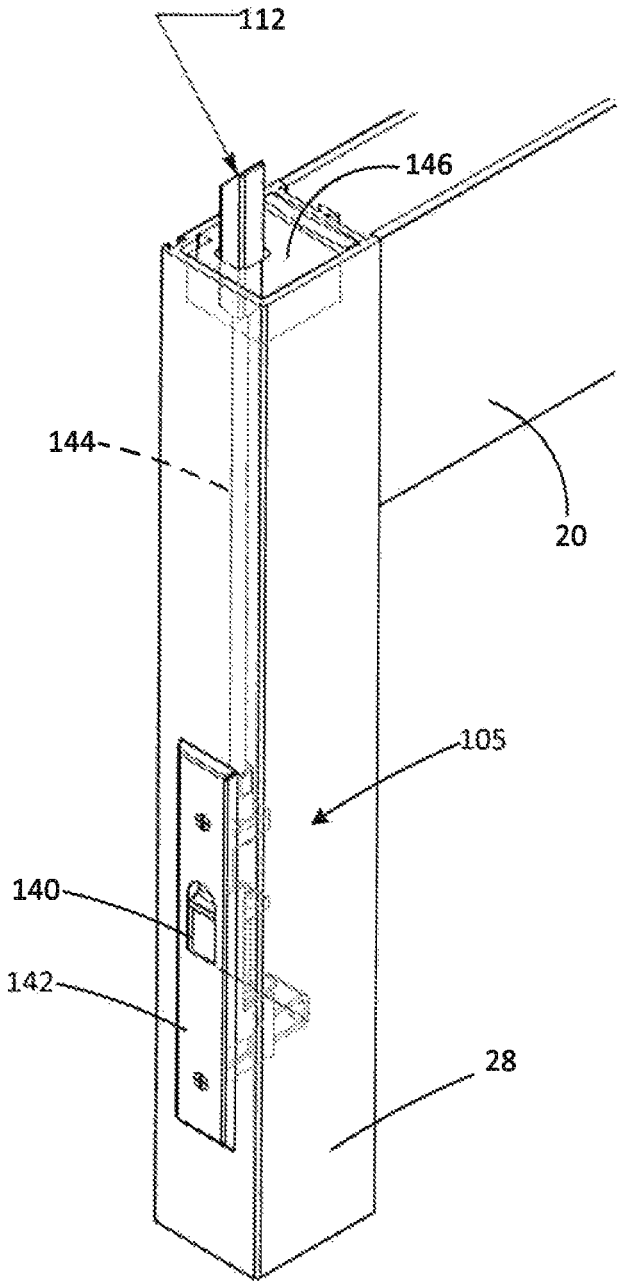
FIG. 2 is a perspective view of a latch assembly of the sliding door system shown in FIG. 1.

FIG. 2 is a perspective view of a latch assembly 105 coupled to a flush bolt assembly 110 (see FIGS. 3A and 3B) according to the teachings of the present disclosure. The latch assembly 105 is contained within the lead rail 28 of the sidelite 14. An actuating member 140 is accessible through a slot formed in a face plate 142. A user uses a finger to displace the actuating member 140 downward. The actuating member 140 is coupled to a connecting rod 144 at one end, and the other end of the connecting rod 144 is threaded into or otherwise engaged and connected to a bore 138 in a sleeve 116 (see FIG. 3B) that is received within the latch bolt 112, as described in more detail below. The latch bolt 112 extends through a guide plate 146 and latches with a bolt keeper (not shown) that is typically secured to the header 16, but in certain embodiments may be secured to the floor track. The flush bolt assembly 110 may also be employed with a swinging door system.

Figure 3A:
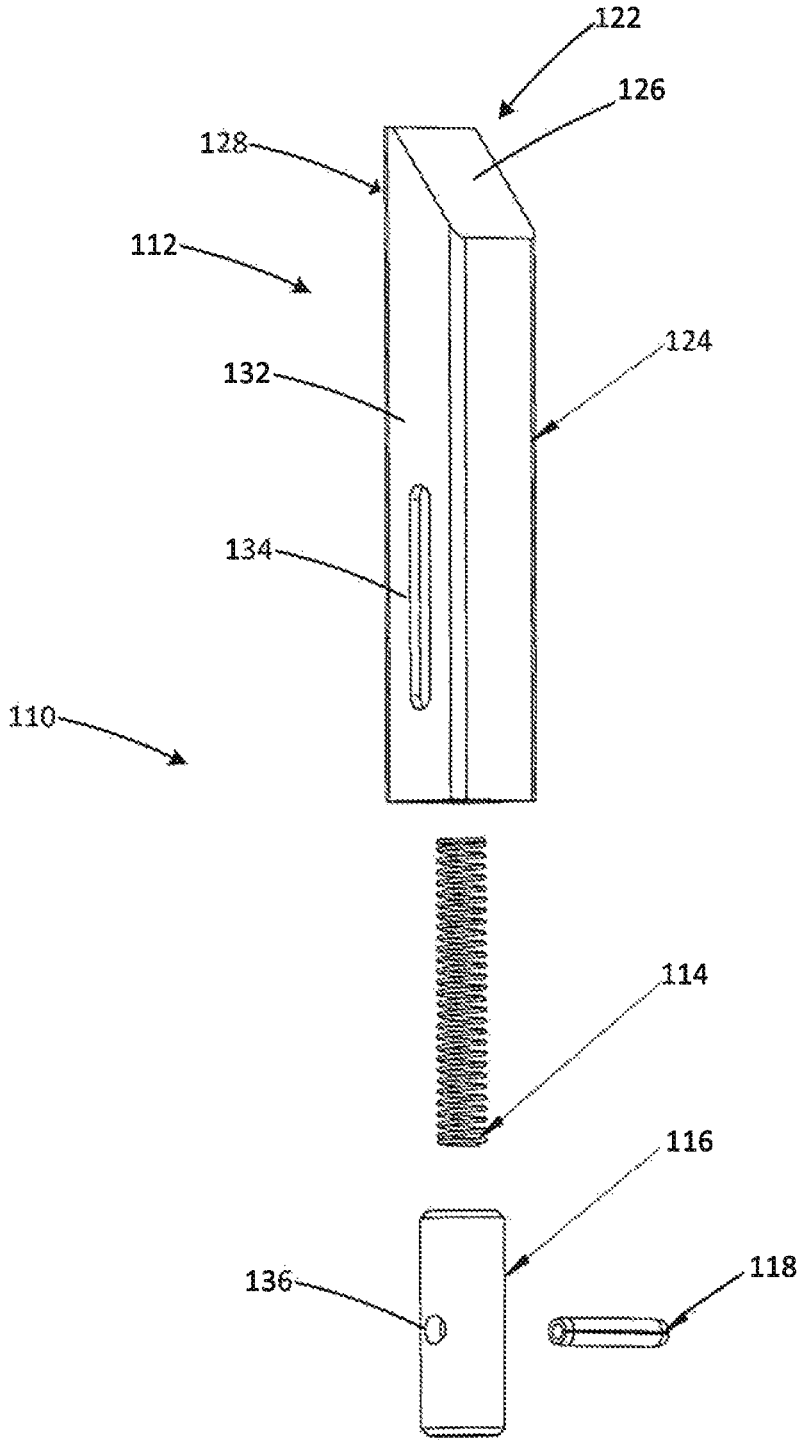
FIG. 3A is an exploded, perspective view of a flush bolt assembly according to the teachings of the present disclosure.
Figure 3B:
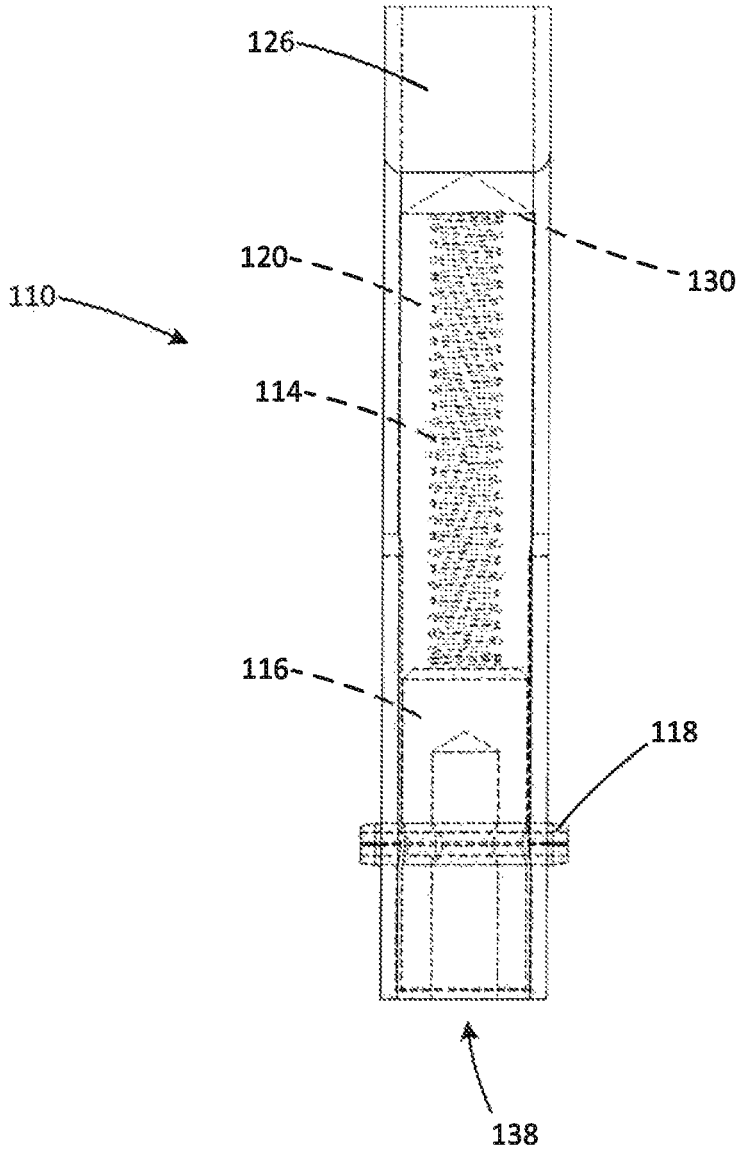
FIG. 3B is a side, elevation view of the flush bolt assembly of FIG. 3A with internal features shown in broken lines.

Reference is made to FIGS. 3A and 3B with continued reference to FIG. 2. FIG. 3A is an exploded view of a flush bolt assembly 110 according to the teachings of the present disclosure. FIG. 3B is a side view of the flush bolt assembly 110 with internal features shown in broken lines. The flush bolt assembly 110 includes a latch bolt 112, a spring 114, a sleeve 116, and a pin 118. The latch bolt 112 includes an interior cavity 120 that receives the spring 114 and at least part of the sleeve 116. The spring 114 is contained within the latch bolt 112, and thus it is fully concealed and protected.

The latch bolt 112 includes a head 122 and a body 124. The head 122 includes a slanted face 126. The latch bolt 112 may also be referred to as a beveled latch bolt 112. Opposite the slanted face 126 is a rear wall 128 that may extend the length of the latch bolt 112. In an extended position, the head 122 extends through the guide plate 146. The guide plate 146 may be secured to the top rail 20 of a panel of a door system (sliding or swinging), for example the sliding door system 10 shown in FIG. 1. In a retracted position, the latch bolt 112 is retracted such that the head 122 is flush with the guide plate 146, and therefore generally flush with the top rail 20. The guide plate 146 includes a hole shaped to allow the latch bolt 112 to extend through.

The latch bolt 112 has a generally elongated body 124 with a square-shaped cross section. The latch bolt 112 may be formed by any suitable metal forming techniques, such as casting, and then machining detailed features in the cast part. According to an alternate embodiment, the latch bolt may be formed of sheet metal that is bent or otherwise formed. According to one embodiment, the general shape of the body 124 and the head 122 is formed by casting a suitable metal, such as aluminum or steel, and then the internal cavity 120 is formed by axially boring a generally cylindrical blind hole defined at least in part by a floor surface 130. The body 124 includes a pair of side walls 132. A guide slot 134 is machined or otherwise formed in each one of the pair of opposed side walls 132.

The spring 114 is a coil spring (also referred to as a helical spring), which stores energy upon compression, and releases this stored energy to extend to its relaxed state. The spring 114 may be a steel compression spring with any suitable spring constant. The spring 114 is received within the interior cavity 120 of the latch bolt 112 and one end of the spring 114 contacts the floor surface 130 of the interior cavity 120. The sleeve 116 is inserted into the interior cavity 120 and contacts the other end of the spring 114. The sleeve 116 may slightly compress the spring 114. The sleeve 116 is retained at least partially within the interior cavity 120 by the pin 118, as explained in further detail below.

The sleeve 116 may be generally cylindrically shaped. A through hole 136 is formed cross-axially in the sleeve 116. The sleeve 116 includes a blind axial bore hole 138, which may be threaded. Alternatively, the blind axial bore hole 138 may be sized to receive a rod in press fit engagement or other means of connecting a rod and a bore hole known by those skilled in the art, such as a pinned connection. The sleeve 116 is formed of any suitable material, such as aluminum or steel. The through hole 136 is sized to receive the pin 118. The pin 118 may be formed by any suitable metal forming technique and may be formed of any suitable metal, such as aluminum or steel.

As discussed above, the sleeve 116 is received by the interior cavity 120 and compresses the spring 114. When the through hole 136 aligns with the guide slot 134, the pin 118 is inserted through the guide slot 134 and the through hole 136. Contact between the pin 118 and an end of the guide slot 134 retains the sleeve 116 within the interior cavity 120. According to certain embodiments, the spring 114 biases the sleeve 116 away from the head 122 and toward the open end of the latch bolt 112.

The latch bolt 112 is displaceable with respect to the sleeve 116. Such displacement of the latch bolt 112 compresses the spring 114 and thereby stores energy in the spring 114. The sleeve 116 remains stationary as the floor surface 130 of the interior cavity 120 moves toward the sleeve 116. This motion is constrained and guided by the guide slot 134. Closing the sidelite 14 to return it to an operable position from a breakout position by a swinging motion, causes the slanted face 126 to contact a strike plate portion of a keeper (not shown). Contact with the slanted face 126 directs the latch bolt 112 downward, which stores energy in the spring 114. Upon clearing the strike plate, the spring 114 releases its energy and thereby extends the latch bolt 112 into the keeper. An opening motion of the door (opposite the sliding or swinging closing motion) is prevented by the rear wall 128 of the latch bolt 112 binding against the keeper.

Actuation of the actuation mechanism displaces the connecting rod 144, which displaces the sleeve 116, and through the engagement of the pin 118 with the guide slot 134 the latch bolt 112 is retracted. Thus, the latch bolt 112 is generally flush with the guide plate 146 and is retracted from the keeper, which allows the door to be opened to a breakout position. Once the actuation mechanism is released, the actuation mechanism may return to its normal, unactuated state, and thus the connecting rod 144 returns the latch bolt 112 into its extended position extended beyond the guide plate 146. In its extended position, the latch bolt 112 is free to be displaced with respect to the sleeve 116 and the connecting rod 144 as described above and independent of the actuation mechanism, for example upon contact with the slanted face 126 on the strike plate when the door is closed.

Although preferred embodiments of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A flush bolt assembly, comprising:

a latch bolt comprising a head and a body, the body having an interior cavity defined by a blind bore between a plurality of sidewalls, a pair of the sidewalls defining a guide slot, the head having a slanted face;

a sleeve at least partially received within the interior cavity and defining a bore hole and a through hole disposed orthogonally to the bore hole;

a pin received through the through hole in the sleeve and through the guide slot in the pair of the sidewalls of the latch bolt; and a compression spring disposed within the interior cavity and contacting at a first end a floor surface of the interior cavity and contacting at a second end opposite to the first end an end surface of the sleeve, the compression spring being configured to store energy upon being compressed between the sleeve and the floor surface.

2. The flush bolt assembly of claim 1, wherein displacement of the sleeve simultaneously displaces the latch bolt.

3. The flush bolt assembly of claim 1, wherein the pin is linearly displaceable in the guide slot.

4. The flush bolt assembly of claim 1, wherein the bore hole is threaded.

* * * * *